US005398447A

United States Patent [19]

Morse

[11] Patent Number: 5,398,447

[45] Date of Patent: Mar. 21, 1995

[54] CENTRALLY LOCATED TILT-IN WINDOW HANDLE

[76] Inventor: Allen D. Morse, 2350 Fairview Dr., Alton, Ill. 62002

[21] Appl. No.: 202,726

[22] Filed: Feb. 28, 1994

[51] Int. Cl.[6] ..... E05D 15/22

[52] U.S. Cl. ..... 49/185; 292/6; 292/67; 292/DIG. 20

[58] Field of Search ..... 49/394, 183, 184, 185; 292/6, 67, 203, DIG. 20, DIG. 35

[56] References Cited

U.S. PATENT DOCUMENTS

| | | | |
|---|---|---|---|
| 201,146 | 3/1878 | Adler | 292/6 X |
| 3,438,153 | 4/1969 | Lemme | 292/67 X |
| 4,227,345 | 10/1980 | Durham | 49/181 |
| 4,961,286 | 10/1990 | Bezubic | 49/175 |
| 5,076,015 | 12/1991 | Manzalini | 49/192 |
| 5,090,750 | 2/1992 | Lindquist | 292/DIG. 20 X |
| 5,127,685 | 7/1992 | Dallaire et al. | 49/185 X |

FOREIGN PATENT DOCUMENTS

| | | | |
|---|---|---|---|
| 341207 | 1/1931 | United Kingdom | 292/6 |

OTHER PUBLICATIONS

P. 21, Home Protection Hardware Catalog Pricelist, dated Jul. 1986.

*Primary Examiner*—Jerry Redman
*Attorney, Agent, or Firm*—Don W. Weber

[57] ABSTRACT

A centrally located window release retractor handle for a tilt-in window is presented. The handle readily attaches to an existing tilt-in window top sash. Attached to the handle is a retractor wheel. Attached to the retractor wheel are left and right retractor cables which are in turn attached to the left and right window release retractors. As the handle and wheel are rotated, the retractor cables are tensioned and draw the window release retractors inwardly. This action allows the tilt-in window to release at the top. The window may then be tilted inwardly by use of the handle leaving the user's other hand free to clean the window. The device is suitable to be mounted on the top of existing tilt-in windows although it may also be manufactured as a complete unit with the handle and retractor cables completely inside the top sash.

4 Claims, 3 Drawing Sheets

CENTRALLY LOCATED TILT-IN WINDOW HANDLE

BACKGROUND OF THE INVENTION

This invention relates to the field involving tilt-in windows More particularly it relates to a centrally located handle which simultaneously retracts both window release retractors of a tilt-in window in one motion.

Of recent introduction into the window market is a particular type of window that not only slides vertically but also tilts in upon the release of certain mechanisms attached to the window itself. The normally sliding window is hinged at either the bottom or top of the window. Each opposite vertical side of the window has a spring-loaded release retractor, one on each vertical side of the window. When it is desired to clean the windows, the pair of retractors are forced inwardly to release the top of the window. The window may then tilt in by pivoting about its lower axis. Examples of these tilt-in windows and improvements thereon may be found in the 1990 patent issued to Bezubic (U.S. Pat. #4,961,286) and the 1991 patent issued to Manzalini (U.S. Pat. #5,076,015). Many other types of tilt-in windows utilizing a pair of window release retractors are well-known in the art.

One drawback in utilizing tilt-in windows is that two hands are required to release the opposed window release retractors. Since one retractor is on one side and the second retractor is on the opposite side of the window, both hands are required in order to simultaneously retract the releases. Another drawback in the use of these retractors is that they are often difficult to grasp, particularly for users who do not have sufficient strength in their fingers to operate the spring-loaded retractors. Additionally, fingernails may be broken or other injuries may be incurred since these retractors commonly have no means for retracting the releases other than by using the tips of the fingers.

It is an object of this invention to provide a centrally located tilt-in window retractor handle which simultaneously will retract both sides of the window release retractors in one motion. It is a further object of this invention to allow the user of a tilt-in window to release the retractors and allow the window to tilt-in using only one hand. It is a still further object of this invention to provide a conveniently located and easily manipulated handle for the purpose of retracting the pair of window release retractors on a tilt-in window. A still further object of this invention is to provide a centrally located tilt-in window retractor handle that is easy to operate and safe to use.

Further and other objects of this invention will become apparent upon reading the following described Specification.

BRIEF DESCRIPTION OF THE PREFERRED EMBODIMENT

A centrally located handle or wheel is provided which is easily adaptable to be attached on the upper edge of a tilt-in window. The L-shaped handle is connected to a retractor wheel which has right and left retractor cables attached to the wheel. Each cable is then attached to the left and right window release retractor respectively. When the centrally located handle is rotated it creates tension upon each cable thus simultaneously retracting the pair of window release retractors which hold a tilt-in window in the vertical position. The tilt-in window may then be tilted inwardly towards the user for cleaning or other purposes.

The particular retractor handle may be specially manufactured with special retractor windows so that the wheel and retractor cables are located within the top sash frame. Alternatively, the handle, wheel, and retractor cables may be secured on top of a standard window and enclosed by a handle/cable bracket. The latter embodiment makes the instant invention adaptable to be used with existing tilt-in windows.

BRIEF DESCRIPTION OF THE DRAWING FIGURES

DETAILED DESCRIPTION OF THE PREFERRED EMBODIMENT

Figure 1:
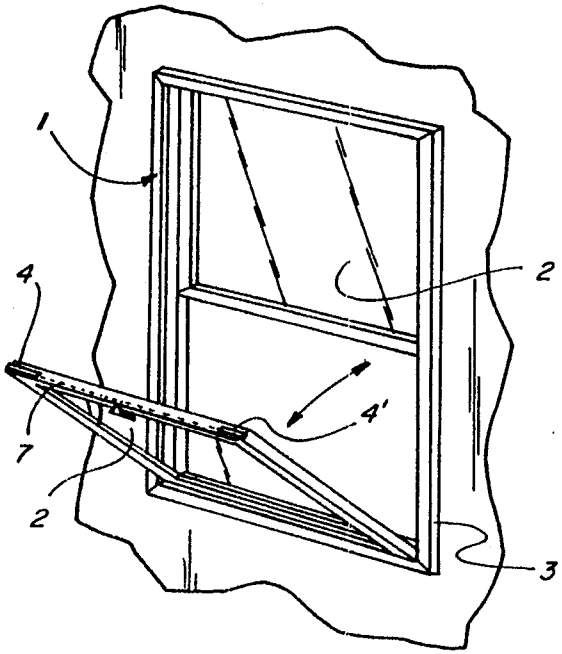
FIG. 1 is a perspective view of the tilt-in window in place within a standard window frame.

A standard window frame 1 is shown in FIG. 1 containing upper and lower windows 2. The lower window 2 is shown in its tilt-in position. This standard tilt-in window may be placed in the position shown in FIG. 2 by retracting the upper window release retractors 4 and 4'. These window release retractors are spring-loaded and normally biased outwardly so that the top of the window is latched to the window frame 1 in the normal position.

In order to tilt in the window, the normally outwardly biased window release retractors, 4 and 4' are moved inwardly such that the top sash of the window releases from the window frame 1 and is free to tilt in about its lower sash axis of rotation 3.

Figure 2:
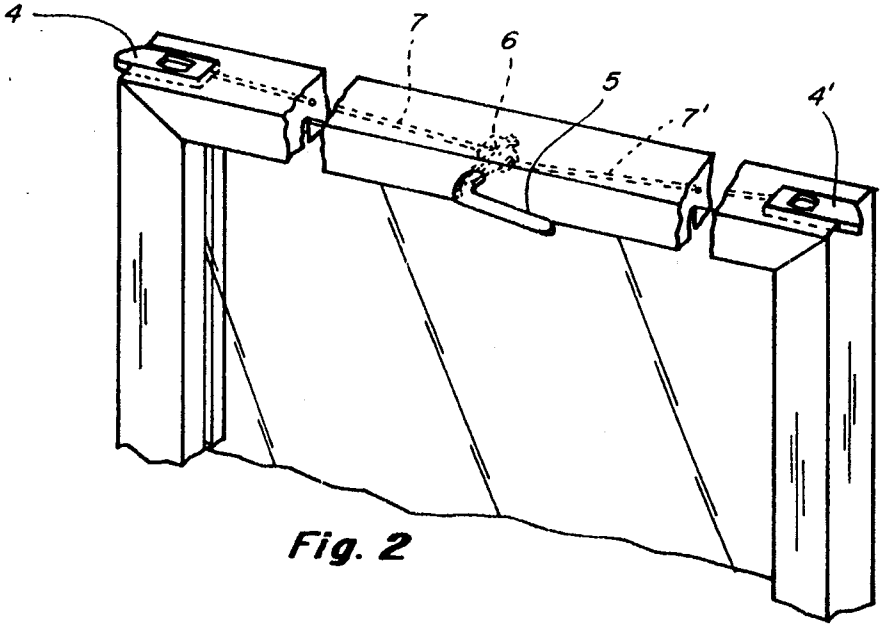
FIG. 2 is a detail perspective view of the top of a tilt-in window shown in partial cut-away.
Figure 6:
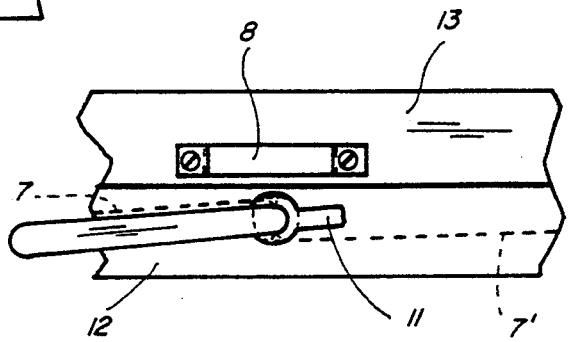
FIG. 6 is a view similar to that shown in FIG. 4 but with the handle in the unlocked position and the release retractors in the unlatched position.
Figure 7:
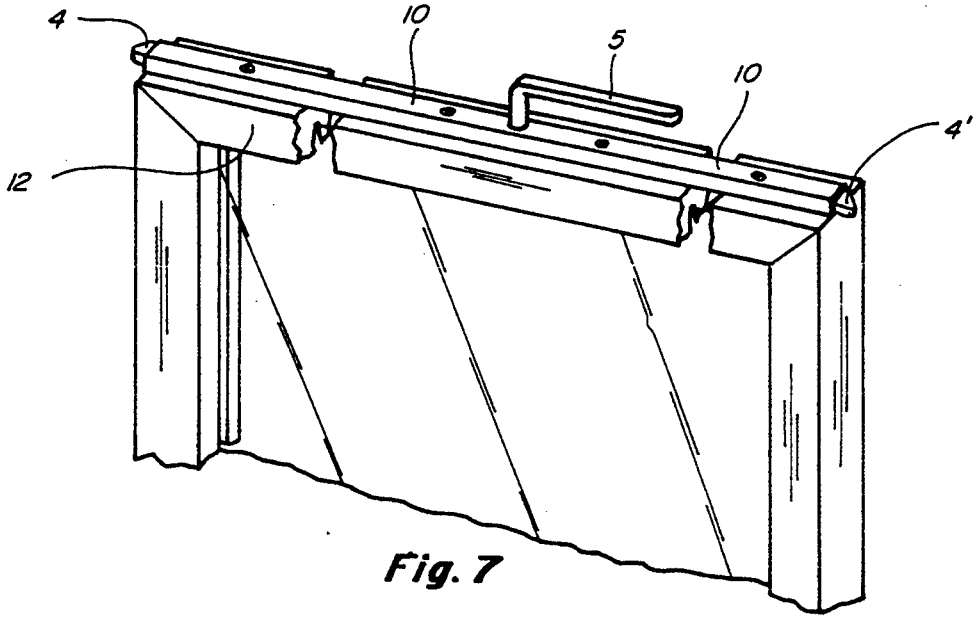
FIG. 7 is a view similar to that of FIG. 2 showing the device in its preferred embodiment as it is attached to an existing tilt-in window system.
Figure 8:
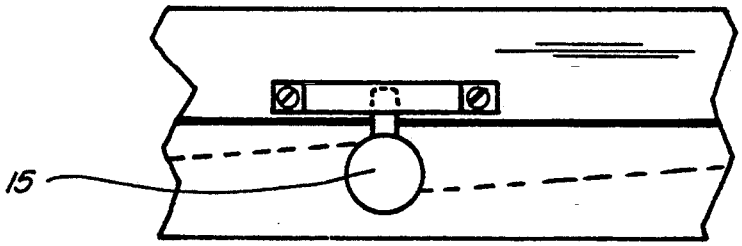
FIG. 8 illustrates a round handle.

Turning now to FIG. 2, a detailed view of the elements and operation of the tilt-in window handle retractor is shown. A handle 5 is centrally located on the top horizontal portion of the tilt-in window as shown in FIGS. 2 and 7. This handle 5 may be L-shaped as shown or may take the form of a round wheel 14 (FIG. 8) or other convenient type of gripping shape. The handle 5 is mechanically connected to a retractor wheel 6, shown on FIG. 3. The handle 5 and retractor wheel 6 are also connected to left 7 and right 7' retractor cables shown in FIGS. 1 through 6. These retractor cables are in turn attached to the left 4 and right 4' window release retractors as shown best in FIGS. 3 through 6.

The centrally located window release retractor handle 5 may have at least two functions in its operation. As shown on FIG. 4 when the handle 5 is positioned with its elongated portion to the right, the retractor cables 7 and 7' are slack, thus applying no inward pressure to the window release retractors 4 and 4'.

Figure 4:
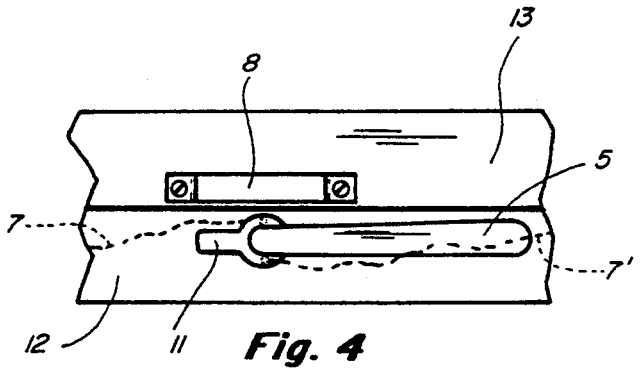
FIG. 4 is a partial top view of the handle on the top window sash showing the window in the latched and unlocked position.

As shown in FIG. 4, a handle locking bracket 8 is located on the window frame. When the window is in its closed position, the top of the window sash 12 is parallel to the window cross bar 13. Attached to the window cross bar 13 is a handle locking bracket 8. When the handle 5 is in the position shown on FIG. 4, the locking part 11 of handle 5 is not engaged with the handle locking bracket 8. Additionally, because the retractor cables 7 and 7' are slack, the window release retractors are in the normally outwardly biased position. As shown on FIG. 5, the window is unlocked but latched in the vertical position by the window release retractors.

Figure 5:
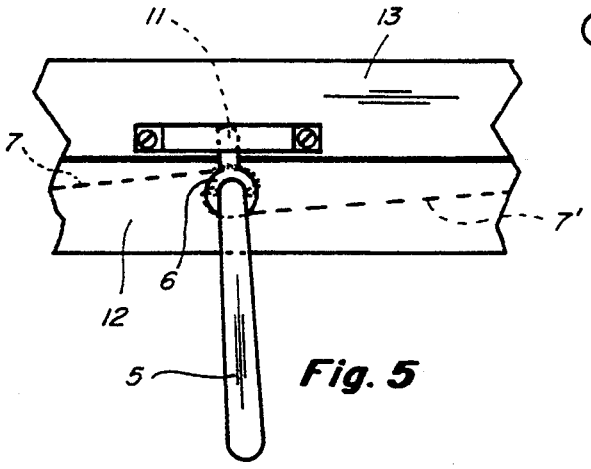
FIG. 5 is a figure similar to that in FIG. 4 but showing the handle in the locked position and the window in the latched position.

As the releasing handle 5 is rotated 90 degrees to the position shown in FIG. 5, the retractor cables 7 and 7' come into tension but, because of their length, they do not retract the normally outwardly biased window release retractors 4 and 4'. However, the locking part 11 of handle 5 is now within the bracket space of bracket 8 located on the window cross bar 13. In this position, the window is locked but the window release retractors are in their normally outwardly biased position. The window is thus locked and latched.

Rotating the handle 5 so that it is positioned 180 degrees from the position shown in FIG. 4 will unlock the window and unlatch the retractors from the window frame. Due to the attachment of the retractor cables 7 to the retractor wheel 6, the further rotation of the retractor handle 5 will tension the retractor cables 7 and 7' so as to pull inwardly the window release retractors 4 and 4' respectively. FIG. 6 illustrates the window in the unlocked and unlatched condition.

The connection of the retractor cables 7 and 7' to the retractor wheel 6 is best shown on FIGS. 4, 5 and 6. It can be seen that the inner ends of the retractor cables are attached about the circumference of the retractor wheel 6 and across the diameter of the wheel as shown on FIG. 4. As the retractor wheel 6 is rotated, the retractor cables 7 and 7' are tensioned to various degrees to allow the release of the retractors 4 and 4' when the cables are tensioned as shown on FIG. 6. It is to be appreciated that different positioning of the attaching of the ends of the retractor cables 7 and 7' to the wheels 6 could allow for a 45 degree/90 degree rotation of the handle to accomplish the same functions shown in FIGS. 4 through 6.

Figure 9:
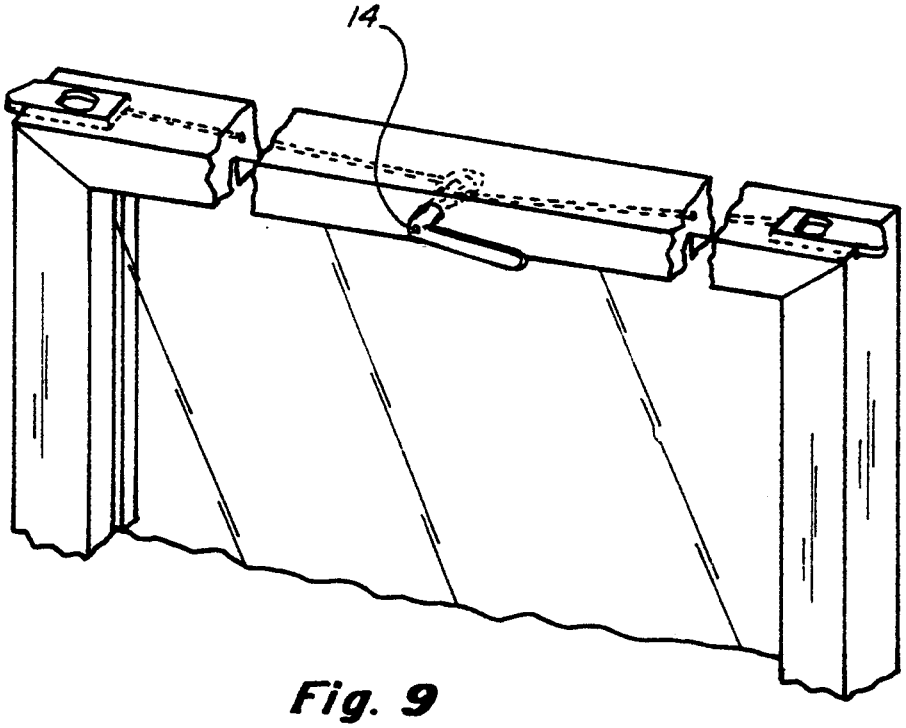
FIG. 9 illustrates a locking mechanism for the round handle as shown in FIG. 8.

The window retractor handle 5 may be equipped with a locking means 15 (FIG. 9) such as is commonly employed on garage doors or other doors. One example of such a key locking door handle with a flat spindle is shown in Part V352CR shown and described in the Home Protection Hardware Manual. The key locking handle described herein is in common use throughout the industry.

While a tilt-in window may come especially equipped with the special locking handle, cables and retractor wheel, as shown in FIG. 2, the preferred embodiment comprises a centrally located tilt-in window handle kit which may be conveniently attached to existing tilt-in windows shown in FIG. 7. The existing tilt-in window kit would be attached to the top of window sash 12 and enclosed by a handle/cable cover 10. The retractor cable mechanism and handle would operate as previously described but the cables, handle and other mechanism would be on the top of the window with the cable ends attached to the left and right window release retractors as shown.

Figure 3:
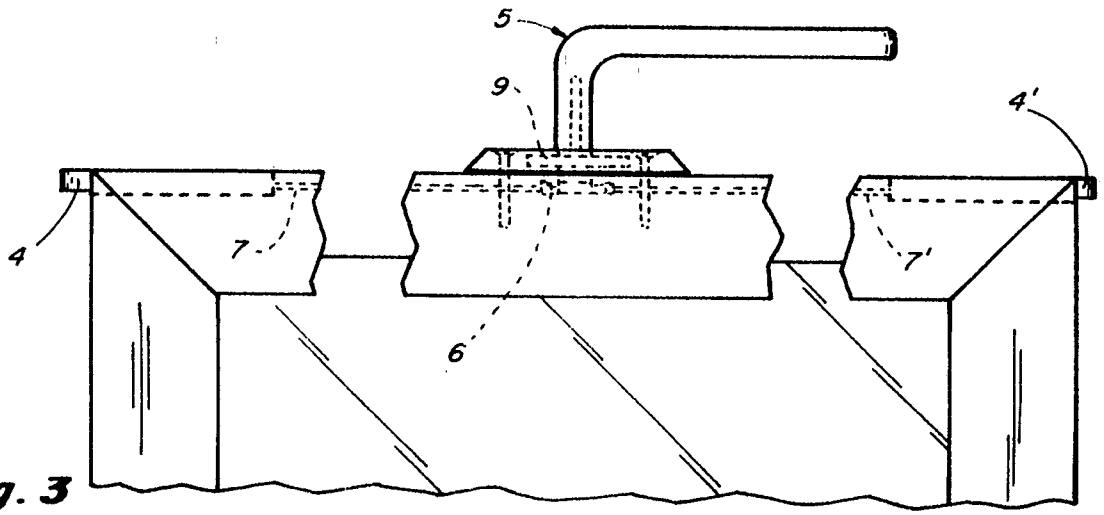
FIG. 3 is an enlarged detailed view of the handle and cable mechanism shown with the inner mechanisms of the handles and cables in dotted lines

When it is desired to use a locking mechanism along with the retractor handle 5, the mechanism may take the form as depicted in FIG. 3. In FIG. 3, the handle is attached to a retractor wheel 6. A second wheel 9 is also attached to the handle shaft. This second wheel 9 would provide the locking mechanism to lock the handle in one position as desired.

The retractor handle 5 may be spring-loaded so that it retains the latched and locked position shown in FIG. 5. The spring-loading mechanism of the handle 5 may also be selected to normally bias the handle in the counterclockwise (FIG. 4) or clockwise (FIG. 6) positions.

The attachable embodiment shown in FIG. 7 may easily be secured to most existing double-hung windows. However, it is to be appreciated that the top sash and frame may need certain modifications to accommodate the handle as it is shown in the Drawing Figures.

This particular device is adaptable to any width window since the width requirement could be accommodated by the length of the cable being used to reach the window release retractors. The system is adaptable to be used on existing window release retractors since a hole or slot may be utilized to attach one end of the retractor cable to the inside edge of the window release retractor. The upper sash handle may include a padded insert to allow the upper sash weight to rest on the lower sash glass without breakage or scratching. The top mounted center handle system shown and described may also be located along the front surface of the window sash (as shown in FIGS. 1 and 2) or located on the top of the window sash (as shown in FIGS. 3–7) while still keeping within the spirit and disclosure of this invention.

It is readily appreciated that the centrally located handle retractor allows easy access to the tilt-in operation of the window by using only one hand. The single centrally located handle is available to operate the pair of window release retractors on a tilt-in window.

Minor variations of the geometric orientation or location of the retractor handle may be made while still within the keeping of this invention.

Having fully described my invention, I claim:

1. A retractor mechanism for a pair of tilt-in window release retractors wherein said retractors are spring-biased outwardly, for a window slidably located within a frame having a cross-bar, said window having a top sash with left, center and right portions, comprising:

(a) a rotatable handle having a retractor wheel attached thereto, said handle located near the center of the top sash;

(b) left and right flexible retractor cables, each cable having one end attached to said retractor wheel and the other end attached to a spring-biased window release retractor;

whereby, rotation of said handle by 180 degrees pulls said window release retractors inwardly thereby releasing the top sash of said window from said frame, wherein said rotatable handle further comprises a locking part attached thereto, further comprising a handle locking bracket on said cross bar adapted to receive said locking part when said rotatable handle is rotated 90 degrees, whereby said mechanism locks said window to said cross bar but does not release said release retractors when said handle is rotated 90 degrees.

2. A retractor mechanism as in claim 1, further comprising a means for locking said handle in a position whereby the window is locked to the cross-bar and the release retractors are biased outwardly.

3. A retractor mechanism as in claim 1, wherein said mechanism is adapted to be located on the top of said top sash, further comprising a cover over said mechanism, whereby said retractor mechanism may be adapted for use on already existing tilt-in windows having a pair of outwardly biased window release retractors.

4. A retractor mechanism as in claim 1, wherein said mechanism is located within said top sash.

* * * * *